US006029871A

United States Patent [19]

Park

[11] Patent Number: 6,029,871

[45] Date of Patent: Feb. 29, 2000

[54] CRADLE DEVICE HAVING ROTATING HINGE IN PAGER

[75] Inventor: Sung-Sun Park, Kyongsangbuk-do, Rep. of Korea

[73] Assignee: Samsung Electronic Co., Ltd., Rep. of Korea

[21] Appl. No.: 09/063,101

[22] Filed: Apr. 20, 1998

[30] Foreign Application Priority Data

Jul. 4, 1997 [KR] Rep. of Korea ..... 97-30971

[51] Int. Cl.[7] ..... A45F 5/00

[52] U.S. Cl. ..... 224/197; 224/666; 224/930

[58] Field of Search ..... 224/197, 199, 224/666, 269, 930, 245; 455/351; 24/3.11, 3.12

[56] References Cited

U.S. PATENT DOCUMENTS

| | | | |
|---|---|---|---|
| 3,956,701 | 5/1976 | James, Jr. et al. | 455/351 |
| 4,100,653 | 7/1978 | Sensabaugh | 224/669 |
| 4,536,925 | 8/1985 | Boothe et al. | 224/269 |
| 5,385,282 | 1/1995 | Chen | 224/269 |
| 5,452,497 | 9/1995 | Peng | 224/197 |
| 5,620,120 | 4/1997 | Tien | 224/271 |
| 5,833,100 | 11/1998 | Kim | 224/930 |

*Primary Examiner*—Linda J. Sholl
*Attorney, Agent, or Firm*—Dilworth & Barrese

[57] ABSTRACT

A cradle device for supporting a pager is provided having a rotatable, pivotable hinge clip. The cradle device includes a body defining a receptacle configured to receive a pager and a pair of rotatable plates secured to the body. The hinge clip is secured to one of the rotatable plates to allow a user to vertically move and rotate the cradle device with the hinge clip attached to a user's belt.

15 Claims, 4 Drawing Sheets

CRADLE DEVICE HAVING ROTATING HINGE IN PAGER

BACKGROUND OF THE INVENTION

1. Technical Field

The present invention relates to a cradle device for a pager, and in particular, to a cradle device including a cradle assembly having a cradle body and a rotating pivotable hinge which facilitates movement of the cradle body to enable a user to easily perceive a message received on an LCD (Liquid Crystal Display).

2. Description of the Related Art

Generally, pagers for use in remote communication include belt clip type or cradle type support structure. As shown in FIG. 1, conventional belt clip-type support structure for a pager 10 having a body 16 includes a belt clip 14 attached to the rear surface of body 16 by a hinge 17. Hinge 17 is positioned at a portion of belt clip 14 to facilitate movement of the belt clip 14 toward and away from the body 16 to a predetermined angle with respect to the rear surface of the body 16 to facilitate attachment of the clip 14 to a user's belt. An LCD 12 is disposed on the upper surface of the body 16 for displaying characters and digits to a user.

As shown in FIG. 2, conventional cradle-type support structure for a pager 20 having a body 16 includes a cradle 18 for retaining body 16 therein, and a belt clip 14 connected to an upper portion of the rear surface of the cradle 18 by a pivotable hinge 17. Belt clip 14 pivots toward and away from the cradle 18 about hinge 17 to a predetermined angle with respect to the rear surface of the cradle 18, in the same manner as the belt clip 14 of the belt-clip type pager 10 shown in FIG. 1. An LCD (not shown) is disposed on the frontal surface of the body 16 for displaying characters and digits to a user.

In the conventional belt clip-type support structure, the LCD is confined to the upper surface of the body, which is the smallest among the six surfaces of the body, to facilitate user viewing of the LCD, thus imposing constraints on the output and design of the LCD. In the conventional cradle-type support structure, the user must remove the pager body from the cradle to view the LCD, since the LCD is difficult to view while the pager body remains in the cradle.

SUMMARY OF THE INVENTION

To overcome the above problems, an object of the present invention is to provide a cradle device for a pager having a cradle body with a rotating pivotable hinge for enabling a user to easily view the output of an LCD with the pager positioned in the cradle body.

Another object of the present invention is to provide a cradle device for a pager having a rotating pivotable hinge for allowing an LCD to be enlarged so that a user can view the output of the LCD without inconvenience even if the LCD is formed on the frontal surface of the pager.

To achieve the above objects, there is provided a cradle device including a cradle body configured to support a pager and having a rotatable, pivotable hinge clip. The cradle body includes a rear plate, a body guide extending from both ends of the rear plate, and a mounting plate extending from the lower end of the rear plate. The cradle device also includes an inner rotating plate, an outer rotating plate, and a hinge clip. The rear plate has a circular mounting groove of a predetermined depth at the center thereof and an installation hole formed at the center of the mounting groove. The inner rotating plate has an annular engaging portion protruding from the center of one surface thereof configured to be inserted into the installation hole. The outer rotating plate has a cylindrical engaging protrusion on one surface thereof configured to be engaged with the engaging portion of the inner plate, and hinge supports each including an aperture, formed on both sides of the other surface thereof. The hinge clip has an outer clip member and an inner clip member attached to one end of the outer clip member by a curved section. A hinge extends from both sides of the curved section where the inner clip member meets the outer clip member. Both ends of the hinge have a larger diameter than a middle portion of the hinge to facilitate attachment of the middle portion of the hinge to the hinge supports. The hinge clip can move toward and away from the rear plate of the cradle body at a predetermined angle to permit a user to view the pager LCD without removing the pager from the cradle device.

BRIEF DESCRIPTION OF THE DRAWINGS

The above objects and advantages of the pager cradle device will become more apparent by describing in detail a preferred embodiment thereof with reference to the attached drawings in which.

DETAILED DESCRIPTION OF PREFERRED EMBODIMENTS

Figure 1:
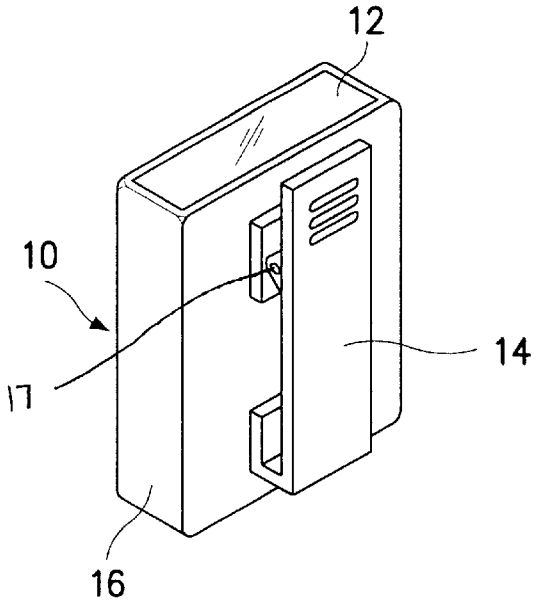
(PRIOR ART) FIG. 1
FIG. 1 is a perspective view of a pager having conventional belt clip-type supporting structure.
Figure 2:
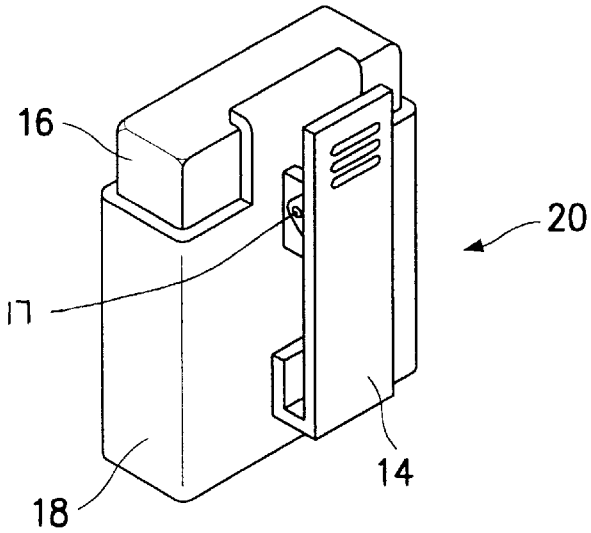
(PRIOR ART) FIG. 2
FIG. 2 is a perspective view of a pager having conventional cradle-type supporting structure.

Preferred embodiments of the presently disclosed cradle device for a pager will be described in detail with reference to the drawings, in which like reference numerals designate identical or corresponding elements in each of the several views.

Figure 3:
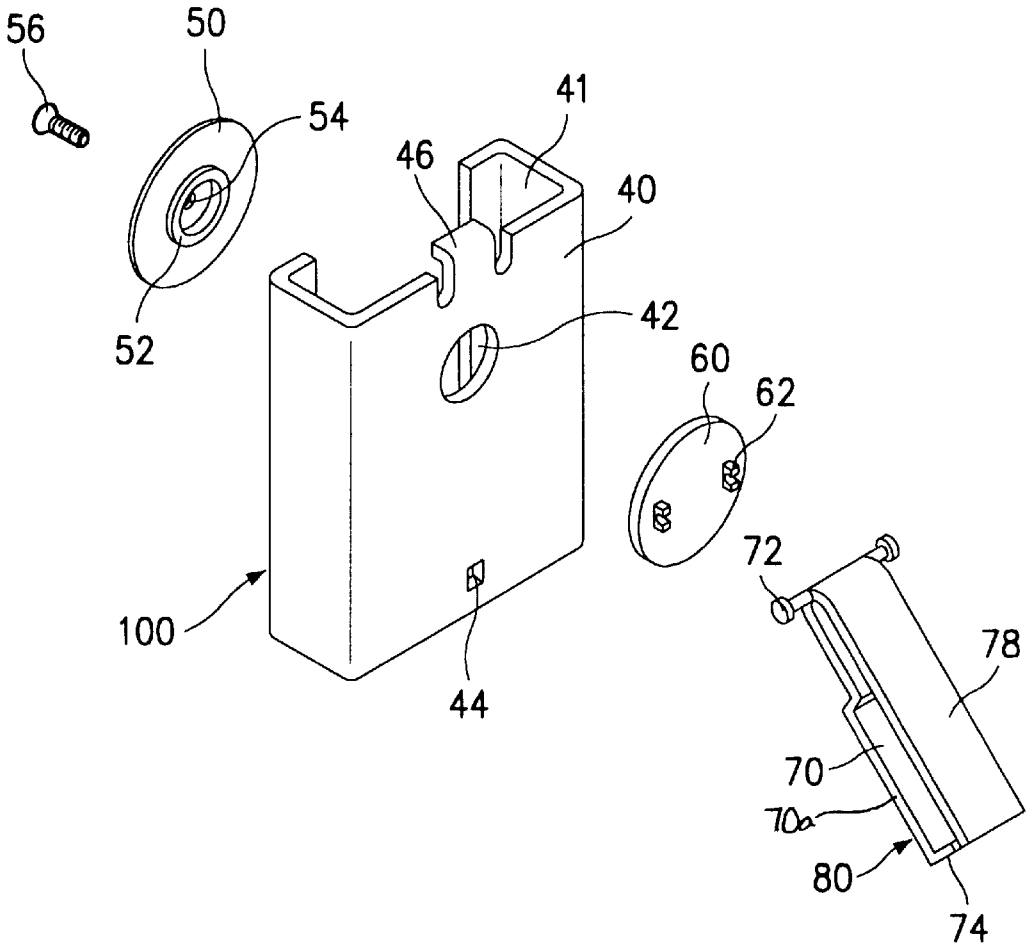
FIG. 3 is an exploded perspective view of one preferred embodiment of the pager cradle device includes a cradle body having a rotatable, pivotable hinge clip.

As shown in FIG. 3, the cradle device includes a cradle body 100 having a rotatable, pivotable hinge clip 80. Body 100 is configured to receive a pager therein. An outer rotating plate 60 is installed on the outer surface of a rear plate 40 of the cradle body 100, and an inner rotating plate 50 is installed on the inner surface of the rear plate 40. Hinge clip 80 is releasably secured to outer rotating plate 60 using hinge supports 62 which are secured to plate 60 and frictionally engage hinge 72. A countersunk screw 56 secures the inner rotating plate 50 to the outer rotating plate 60 via installation hole 42 formed in rear plate 40 of cradle body 100.

Figure 4:
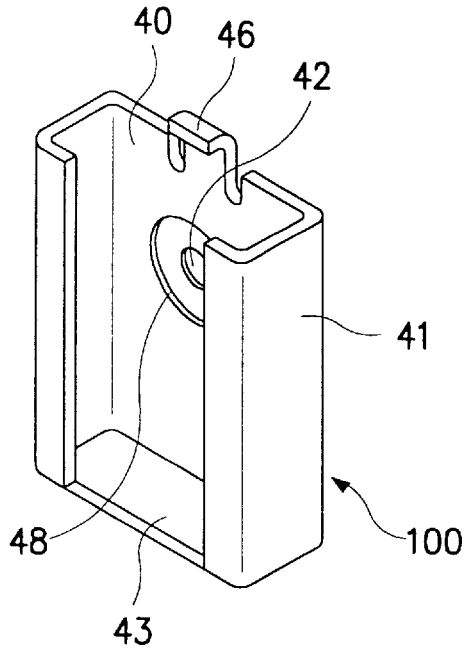
FIG. 4 is a perspective view of cradle body of the cradle device of FIG. 3.

Referring to FIGS. 3 and 4, cradle body 100 includes rear plate 40, a body guide 41 extending from both sides of rear plate 40, a resilient mounting protrusion 46 protruding from the upper end of the rear plate 40, and a mounting plate 43 extending from the lower end of rear plate 40. Mounting plate 43, mounting protrusion 46, and body guides 41 define a receptacle 45 for receiving a pager therein. Mounting protrusion 46 is deflectable to permit a pager to be positioned within receptacle 45.

An annular mounting groove 48 of predetermined depth is formed at the center of the rear plate 40 about installation hole 42. A catching slot 44 is formed in a lower portion of rear plate 40.

The outer rotating plate 60 has a cylindrical engaging protrusion 64 protruding from one surface thereof, and a pair of hinge supports 62 having apertures 63 on an opposite surface thereof. A threaded bore 65 is formed in the engaging protrusion 64 for receiving countersunk screw 56.

Hinge clip 80 includes an outer clip member 78, and an inner clip member 70 extending from one end of outer clip member 78. Inner and outer clip members 70 and 78 are fixedly secured to a hinge 72 such that pivoting of hinge 72 with respect to plate 60 causes clip 80 to pivot.

Figure 5:
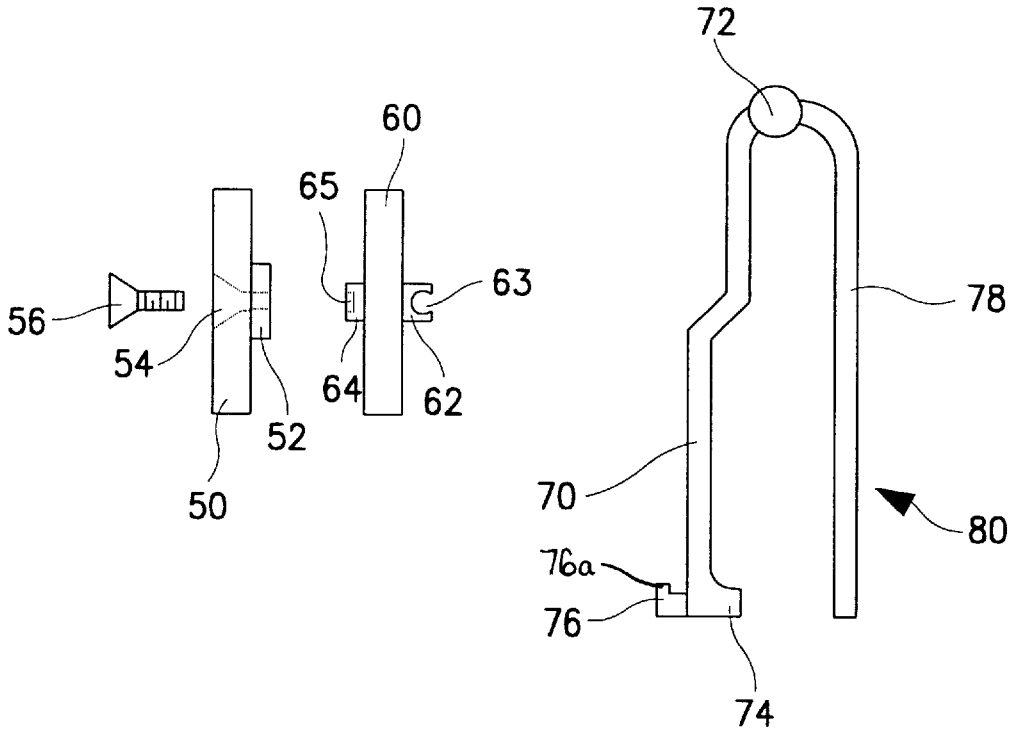
FIG. 5 is a side view of the hinge clip and attachment structure of the cradle device of FIG. 3.

A lower portion 70*a* of the inner clip member 70 is stepped outward. A fixing protrusion 76 (FIG. 5) protrudes outward from an end of the stepped lower portion 70*a* of the inner clip member 70, and has a hooked upward end 76*a*. A catching rib 74 protrudes inward from the end of the stepped lower portion of the inner clip member 70. The diameter of both end portions of the hinge 72 is larger than that of the middle portion thereof to facilitate attachment of the middle portion of hinge 72 to hinge supports 62.

The inner rotating plate 50 includes an annular engaging portion 52 extending from the center of one surface thereof, and a screw hole 54 extending through the center thereof. The screw hole 54 has a wide opening and a sloped inner surface configured to receive countersunk screw 56. The thickness of inner rotating plate 50 is equal to the depth of mounting groove 48, and the height of engaging portion 52 is equal to the depth of installation hole 42 such that when cradle device is assembled, plate 40 has inner and outer smooth surfaces.

Figure 6:
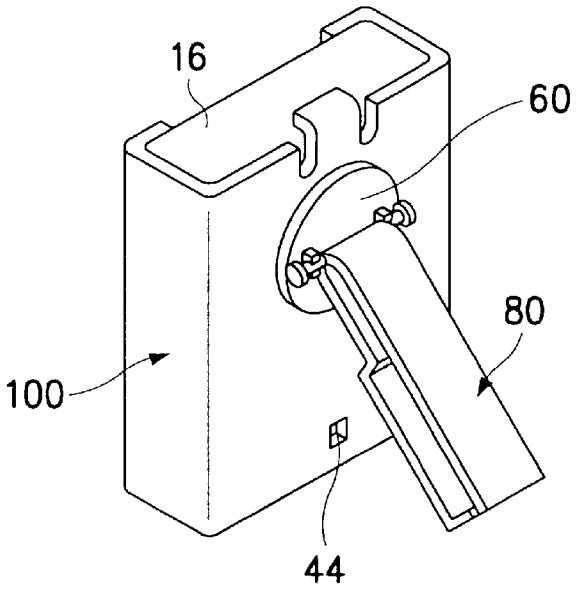
FIG. 6 is a perspective view of the cradle device shown in FIG. 3 with the hinge clip pivoted with respect to the cradle body and a pager supported therein.
Figure 7:
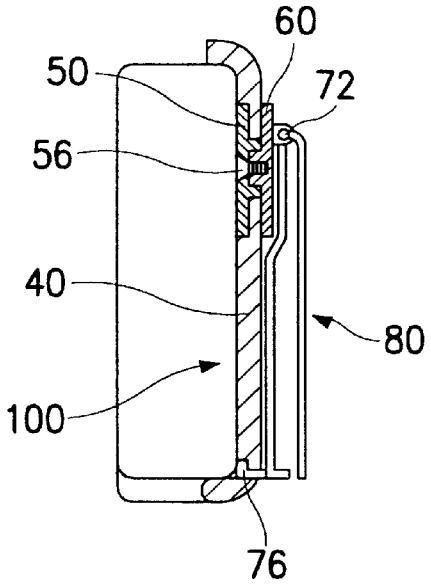
FIG. 7 is a side partial cross-sectional view of the cradle device of FIG. 3 with a pager supported therein.

Referring also to FIGS. 6 and 7, during assembly, inner rotating plate 50 is inserted into the mounting groove 48 of cradle body 100. Concurrently, the engaging portion 52 is inserted into the installation hole 42 of plate 40. Engaging protrusion 64 of plate 60 is inserted into engaging portion 52 of inner rotating plate 50, and countersunk screw 56 is inserted through screw hole 54 of the inner rotating plate 50 and engaging groove 65 of engaging protrusion 64. Thus, the outer rotating plate 60 is engaged with the inner rotating plate 50, and both are rotatable about installation hole 42.

Hinge clip 80 is secured to outer rotating plate 60 by inserting the middle portion of the hinge 72 into the apertures 63 of hinge supports 62 on outer rotating plate 60. Thus, hinge clip 80 can move toward and away from rear plate 40 about hinge 72 to a predetermined angle with respect to rear plate 40. Hinge clip 80 can be fixed to rear plate 40 by inserting fixing protrusion 76 of the inner clip member 70 into catching groove 44 of cradle body 100. In this position, hinge clip 80 is fixed in a position parallel to the rear plate 40 due to the thickness of outer rotating plate 60 and stepped lower portion 70*a* of inner clip member 70.

In the assembled condition, hinge clip 80 can pivot toward and away from the rear plate 40 about hinge 72, and rotate within installation hole 42. Thus, a user can vertically move and rotate cradle body 100 with hinge clip 80 attached to a user's belt, permitting the user to easily view the output of an LCD (not shown) positioned on the frontal surface of pager body 16.

As described above, the cradle device enables the LCD on the frontal surface of the pager to be easily viewed without dislodging the pager body from the cradle. The cradle device also obviates the need to confine the LCD to the upper surface of the pager. Therefore, position and size designing constraints imposed on the LCD of a pager can be overcome.

While the present invention has been illustrated and described with reference to the specific embodiments, it is clearly understood that many variations can be made by anyone skilled in the art within the scope and spirit of the present invention. For example, the pivoting hinge/rotating plate structure disclosed herein could be incorporated directly into a pager, such that no cradle body need be provided. Thus, the appropriate scope hereof is deemed to be in accordance with the claims as set forth below.

What is claimed is:

1. A cradle device, comprising:

a cradle body having a rear plate which includes a circular mounting groove of a predetermined depth at the center thereof and an installation hole formed at the center of the mounting groove, a body guide extending from both ends of the rear plate, and a mounting plate extending from the lower end of the rear plate;

an inner rotating plate having an annular engaging portion protruding from the center of one surface thereof to be inserted into the installation hole;

an outer rotating plate having a cylindrical engaging protrusion on one surface thereof to be engaged with the engaging portion, and hinge supports each including an aperture, formed on the other surface of the outer rotating plate; and a hinge clip having an outer clip member and an inner clip member extending from an end of the outer clip member, and a hinge secured to the inner and outer clip members, the hinge being secured to the hinge supports of the outer rotating plate so that the hinge clip can pivot toward and from the rear plate of the cradle body when both ends of the hinge are positioned within the apertures of the hinge supports.

2. The cradle device claimed in claim 1, wherein an engaging groove is formed on the surface of the engaging protrusion of the outer rotating plate, for engaging with an end of an engaging member, and a screw hole is formed at the center of the inner rotating plate, for inserting the engaging member, so that the inner rotating plate is engaged with the outer rotating plate by inserting the engaging member into the screw hole and the engaging groove.

3. The cradle device having a rotating hinge in a pager as claimed in claim 2, wherein the engaging member is a countersunk screw, and the screw hole of the inner rotating plate has a wide opening and a sloped inner surface, for inserting the countersunk screw.

4. The cradle device having a rotating hinge in a pager as claimed in claim 1, wherein a catching groove is formed on a lower portion of the rear plate, and a fixing protrusion protrudes outward from an end of the inner rib to have an end hooked upward, so that the hinge clip is fixed to the rear plate by inserting the fixing protrusion into the catching groove.

5. The cradle device having a rotating hinge in a pager as claimed in claim 1, wherein a lower portion of the inner rib in the hinge clip is stepped outward, for preventing the hinge clip from inclining in cooperation of the outer rotating plate of a predetermined thickness, and fixing the hinge clip in parallel to the rear plate.

6. A cradle device, comprising:

a cradle body defining a receptacle configured to receive a pager;

a rotation assembly rotatably supported on the cradle body; and a clip having a hinge secured thereto, the clip having inner and outer elongated members, each of the elongated members having first and second ends, the first end of the elongated members being secured to the hinge and the second end of the elongated members defining an opening for receiving a belt, the hinge and clip being secured to the rotation assembly such that the clip, including the first and second elongated members, is pivotably and rotatably movable in relation to the cradle body.

7. A cradle device as claimed in claim 6, wherein the cradle body includes a rear plate, the rotation assembly being rotatably secured to the rear plate.

8. A cradle device as claimed in claim 7, wherein the rear plate of the cradle body includes an installation hole, the rotation assembly extending through and being rotatable about the installation hole.

9. A cradle device as claimed in claim 6, wherein the cradle body has a catching groove formed therein and the clip includes a protrusion, the protrusion being configured to be received within the catching groove to prevent movement of the hinge relative to the cradle body.

10. A cradle device as claimed in claim 6, wherein the cradle body includes a resilient mounting protrusion positioned adjacent the receptacle, the mounting protrusion being positioned to retain a pager within the receptacle.

11. A cradle device as claimed in claim 6, wherein the clip includes a curved section interconnecting the first ends of the first and second elongated members.

12. A cradle device as claimed in claim 11, wherein the hinge is secured to the curved section.

13. A cradle device as claimed in claim 12, wherein the inner elongated member includes a protrusion configured to be received within a catching groove formed in the cradle body to secure the hinge with respect to the cradle body.

14. A cradle device, comprising:

a cradle body defining a receptacle configured to receive a pager, the cradle body having a rear plate, the rear plate of the cradle body having an installation hole;

a rotation assembly rotatably supported on the cradle body; and a clip having a hinge secured thereto, the hinge and clip being secured to the rotation assembly such that the clip is pivotably and rotatably movable in relation to the cradle body, wherein the rotation assembly includes first and second rotating plates, the first rotating plate being positioned within the receptacle adjacent the installation hole and the second rotating plate being positioned outside the receptacle adjacent the installation hole, the first and second plates being secured together by a screw which extends through the installation hole, the rotation assembly being rotatable about the installation hole.

15. A cradle device as claimed in claim 14, wherein the second rotating plate includes at least one hinge support adapted to engage the hinge.

* * * * *